US011311928B2

(12) United States Patent
Takahashi et al.

(10) Patent No.: US 11,311,928 B2
(45) Date of Patent: Apr. 26, 2022

(54) HOT PRESS MACHINE

(71) Applicant: MAZDA MOTOR CORPORATION, Hiroshima (JP)

(72) Inventors: Yuri Takahashi, Hiroshima (JP); Takeshi Matsuda, Hiroshima (JP); Kenji Nakamura, Higashihiroshima (JP); Chie Okawa, Hiroshima (JP); Ichirou Ino, Hiroshima (JP); Naoyuki Irie, Hatsukaichi (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 15 days.

(21) Appl. No.: 16/741,497

(22) Filed: Jan. 13, 2020

(65) Prior Publication Data

US 2020/0238363 A1 Jul. 30, 2020

(30) Foreign Application Priority Data

Jan. 24, 2019 (JP) ..... JP2019-010066

(51) Int. Cl.
*B21D 37/16* (2006.01)
*B21D 22/02* (2006.01)

(52) U.S. Cl.
CPC ..... *B21D 37/16* (2013.01); *B21D 22/022* (2013.01)

(58) Field of Classification Search
CPC ..... B21D 22/10; B21D 22/20; B21D 7/165; B21D 5/008; B21D 22/208; B21D 22/286; B21D 24/16; B21D 37/16; B21D 24/00; B21D 22/022; B24D 24/00; B24D 22/022; C21D 1/673; B30B 15/064; B30B 15/34; B29C 43/52; B29C 2071/025; B29C 51/42; B26C 51/42
USPC ..... 72/342.2
See application file for complete search history.

(56) References Cited

U.S. PATENT DOCUMENTS 8,349,100 B2 * 1/2013 Sunaga ..... B21D 22/02 148/654
8,671,729 B2 * 3/2014 Verma ..... B21D 37/16 72/342.2
8,707,751 B2 * 4/2014 Hielscher ..... C22C 38/02 72/364

(Continued)

FOREIGN PATENT DOCUMENTS

JP 2005169394 A 6/2005
JP 2006-272463 A 10/2006

(Continued)

*Primary Examiner* — Jessica Cahill
*Assistant Examiner* — Jared O Brown
(74) *Attorney, Agent, or Firm* — Studebaker & Brackett PC

(57) ABSTRACT

A lower mold includes: refrigerant ejection ports in its press-molding surface; refrigerant guide grooves in the press-molding surface to guide a refrigerant ejected from the refrigerant ejection ports to an outer portion of the press-molding surface with the refrigerant being in contact with a workpiece; a single connecting groove connected to the refrigerant guide grooves and formed at the outer portion of the press-molding surface into which the refrigerant flows through the refrigerant guide grooves; and discharge ports in the connecting groove. Each of the refrigerant discharge ports is formed at a part of the connecting groove apart from the connecting points between the connecting groove and the refrigerant guide grooves.

7 Claims, 7 Drawing Sheets

(56) References Cited

U.S. PATENT DOCUMENTS

| | | | | |
|---|---|---|---|---|
| 9,061,341 | B2 * | 6/2015 | Kobayashi | B21D 37/16 |
| 9,227,238 | B2 * | 1/2016 | Ishii | B21D 22/286 |
| 2007/0017272 | A1 | 1/2007 | Kurisu et al. | |
| 2011/0219843 | A1 | 9/2011 | Kurisu et al. | |
| 2011/0219848 | A1 | 9/2011 | Kurisu et al. | |
| 2011/0219849 | A1 | 9/2011 | Kuriso et al. | |
| 2014/0305181 | A1 | 10/2014 | Kobayashi | |
| 2016/0114373 | A1 * | 4/2016 | Iwano | B21D 22/208 72/342.2 |
| 2018/0021833 | A1 | 1/2018 | Suzuki et al. | |

FOREIGN PATENT DOCUMENTS

| | | | |
|---|---|---|---|
| JP | 2014205164 | A | 10/2014 |
| JP | 2018012113 | A | 1/2018 |

* cited by examiner

HOT PRESS MACHINE

CROSS-REFERENCE TO RELATED APPLICATION

This application claims priority under Title 35, United States Code, Section 119 on Japanese Patent Application No. 2019-010066 filed on Jan. 24, 2019, the entire disclosure of which is incorporated by reference herein.

BACKGROUND

The present disclosure relates to a hot press machine that press-molds a heated metal workpiece and cools the pressed workpiece using a refrigerant.

An example of this type of hot press machine is described in Japanese Unexamined Patent Publication No. 2018-12113. In this document, a metal workpiece is interposed between upper and lower molds and pressed to have a hat-like cross-section. In this state, a refrigerant circulates through grooves in the press-molding surface of the upper mold to cool the workpiece. In the press-molding surface, a plurality of independent refrigerant guide grooves extend in the longitudinal direction of the workpiece. In each refrigerant guide groove, a refrigerant ejection port is formed at one end and a refrigerant discharge port at the other. Such a hot press machine described in Japanese Unexamined Patent Publication No. 2005-169394 includes refrigerant ejection holes in the press-molding surface of a lower mold and a plurality of refrigerant discharge holes around the ejection holes. In addition, a large number of projections are formed in the press-molding surface to allow a refrigerant to flow therebetween. Japanese Unexamined Patent Publication No. 2014-205164 describes forming vertical and horizontal grooves in a lattice in the press-molding surfaces of upper and lower molds. Refrigerant ejection and discharge ports are formed at the intersections between the vertical and horizontal grooves.

As in Japanese Unexamined Patent Publication No. 2018-12113, if the refrigerant ejection and discharge ports are formed at the ends of each refrigerant guide groove extending straight in the longitudinal direction of the workpiece, an increase in the flow rate of the refrigerant ejected from the refrigerant ejection port and discharged from the refrigerant discharge port is conceivable. As in Japanese Unexamined Patent Publication No. 2005-169394 and Japanese Unexamined Patent Publication No. 2014-205164, if the refrigerant discharge ports are arranged near and around the refrigerant ejection ports in the press-molding surface, it is conceivable that the refrigerant ejected from the refrigerant ejection ports is discharged rapidly from the close discharge ports. The methods of the documents described above cause then excessive promotion of the discharge of the refrigerant circulating through the refrigerant guide grooves, which may lead to insufficient contact between the refrigerant and the workpiece and a decrease in the efficiency of the refrigerant cooling the workpiece. In particular, in Japanese Unexamined Patent Publication No. 2005-169394 and Japanese Unexamined Patent Publication No. 2014-205164, the refrigerant discharge ports are formed in the press molding surface. At the excessive promotion of the discharge of the refrigerant from the refrigerant discharge ports, different amounts of the refrigerant flow around the refrigerant discharge ports, which may cause ununiform cooling throughout the workpiece.

SUMMARY OF THE INVENTION

To address the problems, the present disclosure efficiently cools a workpiece in hot pressing without causing excessive promotion of the discharge of a refrigerant.

In order to solve the problems, a plurality of refrigerant guide grooves in a press-molding surface are connected by a single connecting groove at the outer portion of the press-molding surface. Each refrigerant discharge port is formed at a part of the connecting groove apart from the connecting points between the connecting groove and the refrigerant guide grooves.

A hot press machine according to the present disclosure is for press-molding a heated metal workpiece and cooling the pressed workpiece using a refrigerant. The machine includes: an upper mold and a lower mold, each having a press-molding surface for press-molding the workpiece into a predetermined shape, the press-molding surfaces corresponding to each other.

At least one of the upper mold or the lower mold includes: a refrigerant ejection port in the press-molding surface to eject the refrigerant; a plurality of refrigerant guide grooves in the press-molding surface to guide the refrigerant ejected from the refrigerant ejection port to an outer portion of the press-molding surface with the refrigerant being in contact with the workpiece; a single connecting groove connected to the refrigerant guide grooves and formed at the outer portion of the press-molding surface into which the refrigerant flows from the refrigerant guide grooves; and a discharge port in the connecting groove.

The refrigerant discharge port is formed at a part of the connecting groove apart from connecting points between the connecting groove and the refrigerant guide grooves.

The refrigerant guided by the refrigerant guide grooves to the outer portion of the press-molding surface flows into the connecting groove to reach the refrigerant discharge port. The refrigerant discharge port is formed at the part of the connecting groove apart from the connecting points between the connecting groove and the refrigerant guide grooves. This allows the refrigerant in the refrigerant guide grooves to always flow through the connecting groove into the refrigerant discharge ports, while avoiding direct flow into the refrigerant discharge port without passing through the connecting groove. In this manner, the refrigerant flows through the connecting groove of the outer portion of the press-molding surface, which is advantageous in cooling (quenching) the outer portion of the press-molding surface.

The fact that the refrigerant flows once from the refrigerant guide grooves into the connecting groove means that the connecting groove serves as a resistance to the refrigerant flow path. Between some of the connecting points between the connecting groove and the adjacent refrigerant guide grooves, no refrigerant discharge port is formed. Between these connecting points, the refrigerant particularly tends to stagnate to increase the resistance to the flow path, since the refrigerants flowing from the adjacent connecting points to a position therebetween interfere with each other.

Here, once the refrigerant comes into contact with the workpiece, a part of the refrigerant is heated by the workpiece to become steam to generate a vapor film between the workpiece and a liquid part of the refrigerant. The generation of such vapor film causes insufficient contact between the workpiece and the liquid part of the refrigerant, thereby reducing the efficiency of the refrigerant cooling the workpiece. In this configuration, the refrigerant flowing into the connecting groove increases the resistance to the refrigerant flow path. An increase in the refrigerant ejection pressure increases the filling degree of the refrigerant. As a result, the vapor film on the surface of the workpiece is easily crushed or swept away by the liquid part of the refrigerant to provide sufficient contact between the liquid part of the refrigerant and the workpiece. This reduces a decrease in the cooling efficiency caused by the vapor film.

In one embodiment, the refrigerant ejection port includes a plurality of refrigerant ejection ports arranged at an interval in the press-molding surface. This configuration is advantageous in uniformly cooling the workpiece in a wide range.

In one embodiment, the press-molding surface extends in a longitudinal direction.

At least a part of the press-molding surface has the refrigerant ejection ports arranged alternately on one side and the other side of the press-molding surface, when the press-molding surface is viewed in the longitudinal direction. Some of the refrigerant guide grooves extend from each of the refrigerant ejection ports formed on the one side of the press-molding surface toward the other side of the press-molding surface. The others of the refrigerant guide grooves extend from each of the refrigerant ejection ports formed on the other side of the press-molding surface toward the one side of the press-molding surface.

It is unavoidable to cause a slight difference in the temperature of the refrigerant or cooling time of the workpiece between the areas around the refrigerant ejection ports, which eject the refrigerant, and the areas around the distal ends of the refrigerant guide grooves, to which the refrigerant flows. That is, it is unavoidable to cause a slight difference in the performance of the refrigerant cooling the workpiece between the areas around the refrigerant ejection ports and the areas around the distal ends of the refrigerant guide grooves. In this embodiment, however, the refrigerant ejection ports are arranged alternately on one and the other sides of the press-molding surface. This reduces intensive cooling only on one side of the workpiece. That is, the uniformity in the strength of the press-molded product as a whole increases in the transverse direction of the press-molding surface.

In one embodiment, each of the upper and lower molds includes: the refrigerant ejection ports arranged alternately; and the refrigerant guide grooves extending from the refrigerant ejection ports.

Each of the refrigerant ejection ports on the one side of one of the upper and lower molds is located in an intermediate position between adjacent ones of the refrigerant ejection ports on the one side of the other of the molds. Each of the refrigerant ejection ports on the other side of one of the upper and lower molds is located in an intermediate position between adjacent ones of the refrigerant ejection ports on the other side of the other of the molds.

In short, the refrigerant ejection ports of the press-molding surfaces of the upper and lower molds are arranged alternately on one and the other sides in the inverted manners not to positionally overlap each other in the vertical direction.

According to this configuration, the distal ends of the refrigerant guide grooves, in which the refrigerant exhibits lower cooling performance, of one of the upper and lower molds correspond to the areas around the refrigerant ejection ports, in which the refrigerant exhibits higher cooling performance, of the other of the upper and lower molds. This increases the uniformity in the strength of the press-molded product in the transverse direction of the press-molding surface.

In one embodiment, the press-molding surface extends in a longitudinal direction.

The refrigerant guide grooves extend from the refrigerant ejection port not in the longitudinal direction but in a transverse direction of the press-molding surface.

According to this configuration, the refrigerant guide grooves extend in the transverse direction of the press-molding surface. This reduces the refrigerant flow path as compared to the case where the refrigerant guide grooves extend in the longitudinal direction of the press-molding surface.

In one embodiment, in order to provide a press-molded product with a substantially hat-like cross section from the workpiece, the press molding surface of each of the upper and lower molds includes: a top wall molding part configured to mold a top wall of the hat-like press-molded product; side wall molding parts continuous with the top wall molding part and configured to mold side walls of the press-molded product, the side wall molding parts corresponding to each other; and flange molding parts continuous with the respective side wall molding parts and configured to mold flanges of the press-molded product.

The refrigerant ejection port is formed in the top wall molding part of the press-molding surface.

The refrigerant guide grooves extend from the refrigerant ejection port in the top wall molding part through the side wall molding parts to the flange molding parts that form the outer portion of the press-molding surface.

A refrigerant discharge port is formed in the flange molding part.

The refrigerant ejection port is formed in the top wall molding part, that is, relatively high position, of the press-molding surface, whereas the refrigerant discharge port are formed in the flange molding part, that is, relatively low position. The refrigerant thus smoothly flows from the refrigerant ejection port through the refrigerant guide grooves toward the refrigerant discharge port. This is advantageous in providing a press-molded product with a hat-like cross-section and highly uniform strength.

In one embodiment, each of the flanges of the press-molded product includes a part requiring relatively high surface accuracy and a part requiring relatively low surface accuracy.

Each of the refrigerant guide grooves extends not toward the part of an associated one of the flange molding parts requiring the high surface accuracy but toward the part requiring the low surface accuracy.

The region of the workpiece being in contact with the refrigerant flowing through the refrigerant guide grooves is deprived of the heat by the refrigerant to be cooled relatively rapidly as compared to both sides of the refrigerant guide grooves not being in direct contact with the refrigerant. Accordingly, a distortion may occur in the workpiece under influence of the expansion due to a martensitic transformation, for example. In this embodiment, each refrigerant guide grooves extend toward the part of the associated one of the flange molding parts requiring the lower surface accuracy. This reduces generation of a distortion at the part requiring higher surface accuracy in the workpiece.

The part requiring higher surface accuracy may include, for example, the part of the workpiece to be welded, the part of the workpiece overlapping another component, or the part of the workpiece for forming a positioning hole or a positioning pin. Since the surface accuracy of the part is not largely reduced by quenching, it is advantageous in welding, overlapping with the other component, and the positioning of the component.

The refrigerant may be a liquid refrigerant or a mist refrigerant. The liquid refrigerant may be made of, for example, water, alcohol, or oil in one preferred embodiment.

DESCRIPTION OF EMBODIMENTS

Embodiments of the present disclosure will now be described with reference to the drawings. The following description of preferred embodiments is only an example in nature and is not intended to limit the scope, applications, or use of the present disclosure.

Figure 1:
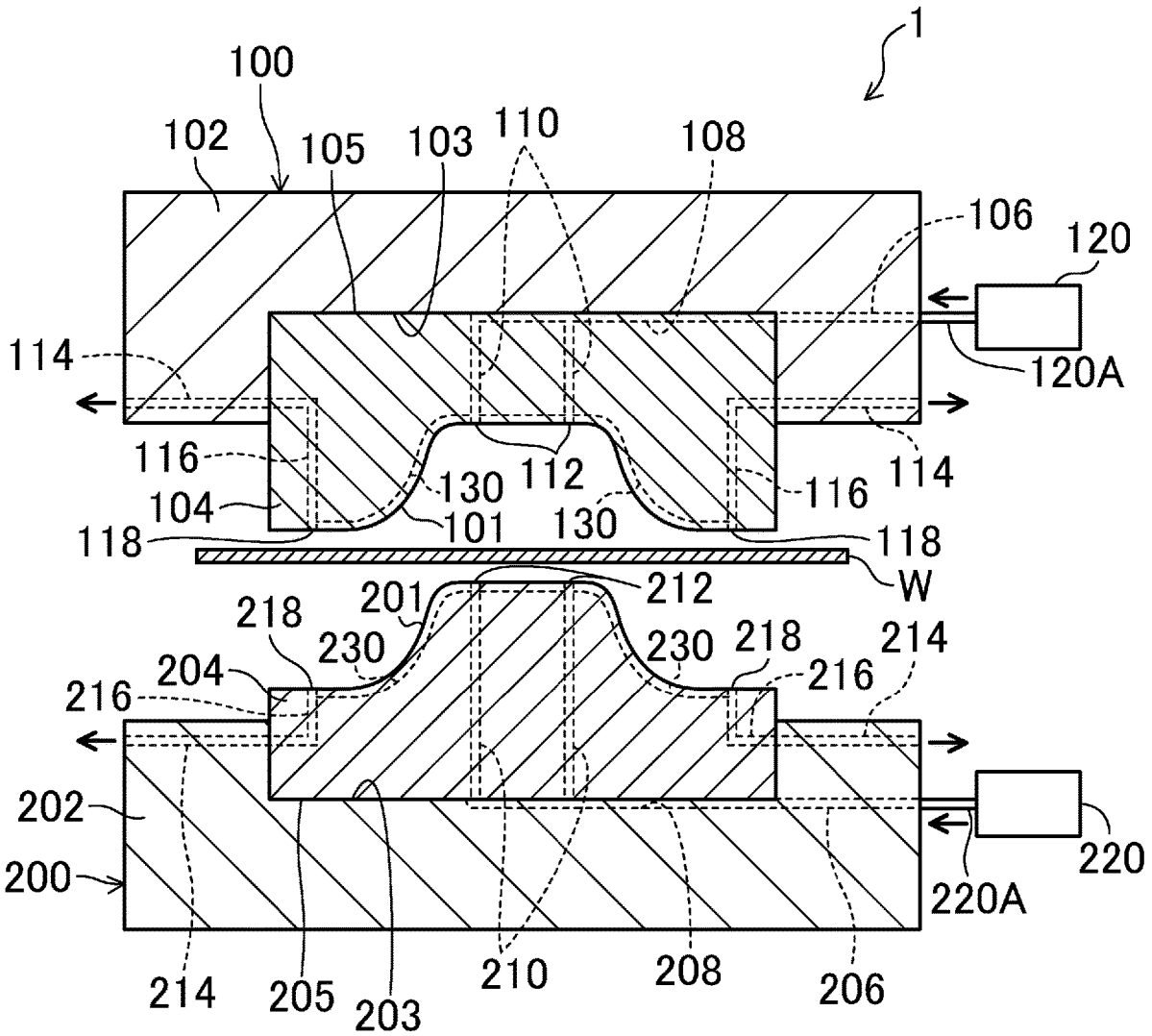
FIG. 1 is a cross-sectional view of a hot press machine according to an embodiment.

A hot press machine 1 shown in FIG. 1 includes an upper mold unit 100 and a lower mold unit 200. The machine press-molds a heated plate-like metal workpiece (e.g., steel plate) W into a predetermined shape and supplies a refrigerant (e.g., cool water) to the press-molding surface to cool (i.e., quench) the workpiece W. Configurations of the hot press machine 1 according to this embodiment will now be described.

Upper Mold Unit 100

The upper mold unit 100 includes an upper mold (metallic mold) 104 and an upper mold holder 102. The upper mold 104 has a press-molding surface 101 for molding the workpiece W such that the workpiece W has a hat-like cross section. The upper mold holder 102 holds the upper mold 104. An upper surface 105 of the upper mold 104 is in contact with a lower surface 103 of the upper mold holder 102. The upper mold unit 100 is movable and fixed to a slider of the press machine. Upward and downward movement of the slider displaces the unit from a press position close to the lower mold unit 200 to a standby position apart upward from the lower mold unit 200. The slider serves as a displacement mechanism of the upper mold unit 100.

The upper mold holder 102 has a refrigerant supply hole 106 penetrating therethrough. The refrigerant supply hole 106 is connected to a refrigerant supplier 120 via a supply pipe 120A. The refrigerant supply hole 106 is connected to a refrigerant supply groove 108 formed in the upper surface 105 of the upper mold 104. The refrigerant supply groove 108 is connected to a plurality of refrigerant supply holes 110 penetrating the upper mold 104 and extending downward.

The lower ends of the refrigerant supply holes 110 of the upper mold 104 are formed as refrigerant ejection ports 112 in the press-molding surface 101. The press-molding surface 101 has refrigerant guide grooves 130 that guide the refrigerant ejected from the refrigerant ejection ports 112 to the outer portion of the press-molding surface 101 with the refrigerant being in contact with the upper surface of the workpiece W.

The upper mold 104 has a plurality of refrigerant discharge holes 116 penetrating therethrough. The refrigerant discharge holes 116 are formed as refrigerant discharge ports 118 at the outer portion of the press-molding surface 101. These refrigerant discharge ports 118 communicate with the refrigerant guide grooves 130. Each of the refrigerant discharge holes 116 is connected to one of refrigerant discharge holes 114 formed in the upper mold holder 102.

The refrigerant supplied from the refrigerant supplier 120 passes through the supply pipe 120A, the refrigerant supply hole 106 of the upper mold holder 102, the refrigerant supply groove 108 of the upper mold 104, and the refrigerant supply holes 110. The refrigerant is then ejected from the refrigerant ejection ports 112 formed in the press-molding surface 101. This refrigerant passes through the refrigerant guide grooves 130 covered by the press-molded workpiece W and is guided to the outer portion of the press-molding surface 101. The refrigerant flows through the refrigerant guide grooves 130 of the press-molding surface 101 while being in contact with the workpiece W, thereby cooling the work W from above. The refrigerant flows from the refrigerant discharge ports 118 formed at the outer portion of the press-molding surface 101 into the refrigerant discharge holes 116 of the upper mold 104. The refrigerant then passes through the refrigerant discharge holes 114 of the upper mold holder 102 and is discharged outside the upper mold unit 100.

Lower Mold Unit 200

The lower mold unit 200 is a fixed mold including a lower mold (metallic mold) 204 and a lower mold holder 202. The lower mold 204 has a press-molding surface 201 for molding, together with the press-molding surface 101 of the upper mold 104, the workpiece W such that the workpiece W has the hat-like cross section. The lower mold holder 202 holds the lower mold 204. A lower surface 205 of the lower mold 204 is in contact with an upper surface 203 of the lower mold holder 202.

The lower mold holder 202 has a refrigerant supply hole 206 penetrating therethrough. The refrigerant supply hole 206 is connected to a refrigerant supplier 220 via a supply pipe 220A. The refrigerant supply hole 206 is connected to a refrigerant supply groove 208 formed in the upper surface 203 of the lower mold holder 202. The refrigerant supply groove 208 is connected to a plurality of refrigerant supply holes 210 penetrating the lower mold 204 and extending upward.

The upper ends of the refrigerant supply holes 210 of the lower mold 204 are formed as refrigerant ejection ports 212 in the press-molding surface 201. The press-molding surface 201 has refrigerant guide grooves 230 that guide the refrigerant ejected from the refrigerant ejection ports 212 to the outer portion of the press-molding surface 201 with the refrigerant being in contact with the lower surface of the workpiece W.

The lower mold 204 has a plurality of refrigerant discharge holes 216 penetrating therethrough. The refrigerant discharge holes 216 are formed as refrigerant discharge ports 218 at the outer portion of the press-molding surface 201. These refrigerant discharge ports 118 communicate with the refrigerant guide grooves 230. Each of the refrigerant discharge holes 216 is connected to one of refrigerant discharge holes 214 formed at the lower mold holder 202.

The refrigerant supplied from the refrigerant supplier 220 passes through the supply pipe 220A, the refrigerant supply hole 206 of the lower mold holder 202, the refrigerant supply groove 208 of the lower mold 204, and the refrigerant supply holes 210. The refrigerant is then ejected from the refrigerant ejection ports 212 formed in the press-molding surface 201. This refrigerant passes through the refrigerant guide grooves 230 covered by the press-molded workpiece W and is guided to the outer portion of the press-molding surface 201. The refrigerant flows through the refrigerant guide grooves 230 of the press-molding surface 201 while being in contact with the workpiece W, thereby cooling the workpiece W from below. The refrigerant flows from the refrigerant discharge ports 218 formed at the outer portion of the press-molding surface 201 into the refrigerant discharge holes 216 of the lower mold 204. The refrigerant then passes through the refrigerant discharge holes 214 of the lower mold holder 202 and is discharged outside the lower mold unit 200.

Refrigerant Flow Path in Press-Molding Surface 201 of Lower Mold 204

Figure 2:
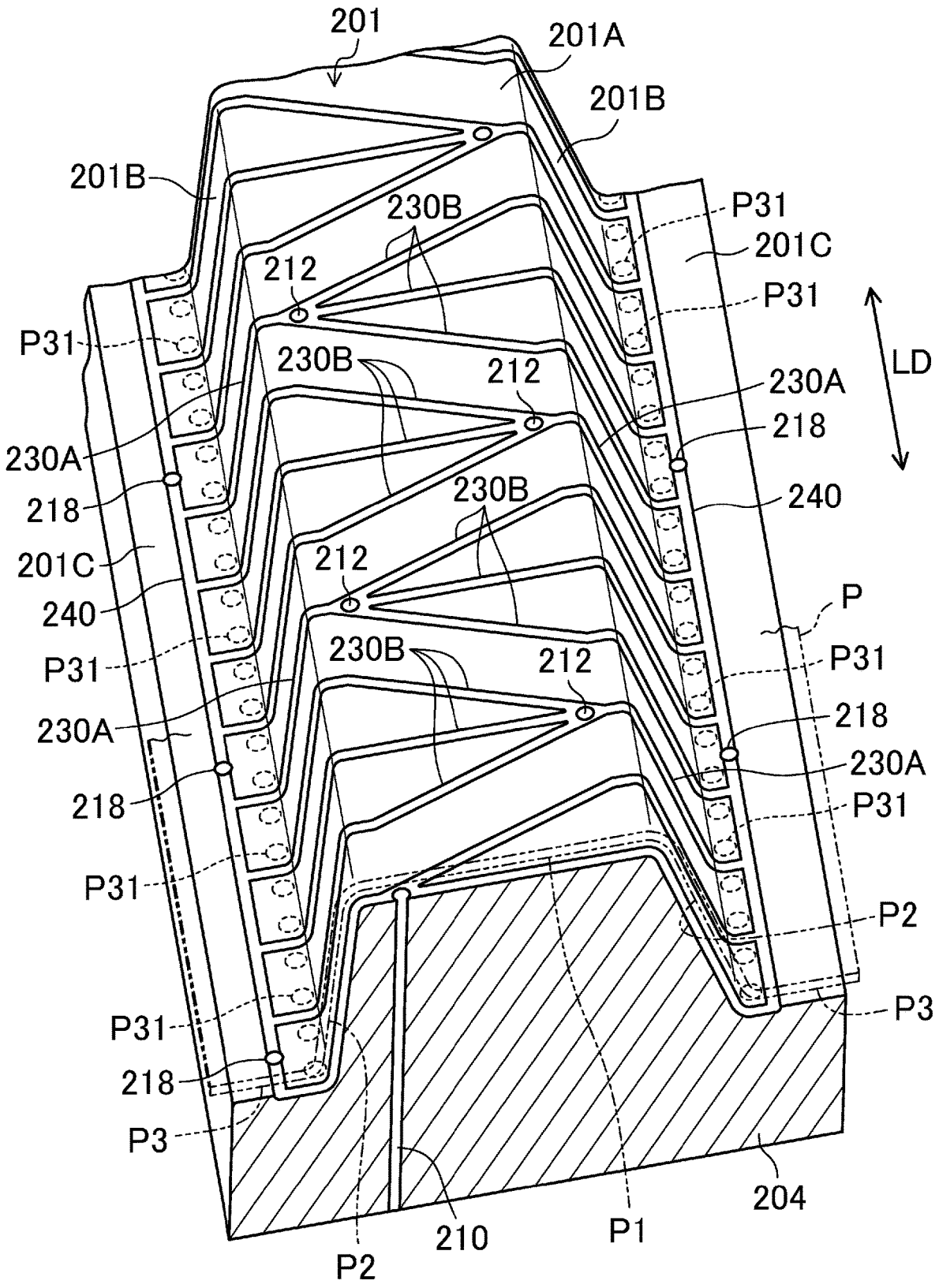
FIG. 2 is a perspective view, including a cross section, of a lower mold of the machine.

As shown in FIG. 2, in order to form a long press-molded product P with a hat-like cross section from the workpiece W, the press-molding surface 201 of the lower mold 204 extends in a longitudinal direction LD corresponding to the longitudinal direction of the press-molded product P. This press-molding surface 201 includes a top wall molding part 201A, side wall molding parts 201B, and flange molding parts 201C. The top wall molding part 201A molds a top wall P1 of the hat-like press-molded product P. The side wall molding parts 201B are continuous with the top wall molding part 201A and mold side walls P2 of the press-molded product P. The parts 201B correspond to each other. The flange molding part 201C are continuous with the respective side wall molding parts 201B and mold flanges P3 of the press-molded product P.

The refrigerant ejection ports 212 described above are formed in the top wall molding part 201A of the press-molding surface 201 at an interval in the longitudinal direction LD of the press-molding surface 201. In this embodiment, the refrigerant ejection ports 212 are arranged alternately on one and the other sides of the top wall molding part 201A, in short, in a zigzag, when the press-molding surface 201 is viewed in its longitudinal direction.

The refrigerant guide grooves 230 extend from the refrigerant ejection ports 212 not in the longitudinal direction LD but in the transverse direction of the press-molding surface 201. In this embodiment, the plurality of independent refrigerant guide grooves 230 extend from each of the refrigerant ejection ports 212. Hereinafter, reference numeral 230 is used to collectively refer to the refrigerant guide grooves, and alphabetic characters are added to the reference numeral 230 like "230A" to refer to the individual refrigerant guide grooves.

First, a single refrigerant guide groove 230A and a plurality of (three in this embodiment) refrigerant guide grooves 230B extend from each of the refrigerant ejection ports 212 on one side of the top wall molding part 201A. The refrigerant guide groove 230A passes through the top wall molding part 201A toward the side wall molding part 201B on the one side. The refrigerant guide grooves 230B pass through the top wall molding part 201A toward the side wall molding part 201B on the other side.

The refrigerant guide groove 230A heading for the side wall molding part 201B on the one side extends from the top wall molding part 201A across the side wall molding part 201B on the one side to the flange molding part 201C on the one side, which forms the outer portion of the press-molding surface 201. The refrigerant guide grooves 230B heading for the side wall molding part 201B on the other side extend through the top wall molding part 201A to the side wall molding part 201B on the other side at an interval expanding in the longitudinal direction LD of the press-molding surface 201. The refrigerant guide grooves 230B extend across this side wall molding part 201B to the flange molding part 201C on the other side, which forms the outer portion of the press-molding surface 201.

Similarly, a single refrigerant guide groove 230A and a plurality of refrigerant guide grooves 230B extend from each of the refrigerant ejection ports 212 on the other side of the top wall molding part 201A. The refrigerant guide groove 230A passes through the top wall molding part 201A toward the side wall molding part 201B on the other side. The refrigerant guide grooves 230B pass through the top wall molding part 201A toward the side wall molding part 201B on the one side.

The refrigerant guide groove 230A heading for the side wall molding part 201B on the other side extends from the top wall molding part 201A across the side wall molding part 201B on the other side to the flange molding part 201C on the other side. The refrigerant guide grooves 230B heading for the side wall molding part 201B on the one side extend through the top wall molding part 201A to the side wall molding part 201B on the one side at an interval expanding in the longitudinal direction LD of the press-molding surface 201. The refrigerant guide grooves 230B extend across this side wall molding part 201B to the flange molding part 201C on the one side.

The refrigerant guide grooves 230B extending from each of the refrigerant ejection ports 212 on one side toward the other side include, between adjacent ones of the refrigerant ejection ports 212 on the other side, a part in which the interval expands toward the other side. This is for aligning the refrigerant ejection ports 212 on the other side and the refrigerant guide grooves 230B at a substantially equal interval in the longitudinal direction of the press-molding surface 201.

Similarly, the refrigerant guide grooves 230B extending from each of the refrigerant ejection ports 212 on the other side toward the one side include, between adjacent ones of the refrigerant ejection ports 212 on the one side, a part in which the interval expands toward the one side. This is for aligning the refrigerant ejection ports 212 on the one side and the refrigerant guide grooves 230B at a substantially equal interval in the longitudinal direction of the press-molding surface 201.

Such alternate arrangement of the refrigerant ejection ports 212 and such arrangement of the refrigerant guide grooves 230B extending from the refrigerant ejection ports 212 at the expanding interval allow the refrigerant guide grooves 230 to cover the whole top wall molding part 201A and the whole side wall molding parts 201B of the press-molding surface 201.

The flange molding part 201C on the one side, which forms the outer portion of the press molding surface 201, has a single connecting groove 240 extending in the longitudinal direction LD of the press-molding surface 201. This connecting groove 240 is connected to the refrigerant guide grooves 230 extending to the one side at an interval in the longitudinal direction LD. Similarly, the flange molding part 201C on the other side, which forms the outer portion of the press-molding surface 201, has a single connecting groove 240 extending in the longitudinal direction LD of the press molding surface 201. This connecting groove 240 is connected to the refrigerant guide grooves 230 extending to the other side at an interval in the longitudinal direction LD. The refrigerant guide grooves 230 extending from the refrigerant ejection ports 212 neither branch halfway nor merge with the other refrigerant guide grooves to extend toward one or the other of the flanges molding parts 201C to be connected to the connecting groove 240 at the one or the other side. No refrigerant ejection port is formed halfway in the refrigerant guide grooves 230. Each of the refrigerant guide grooves 230 receives the refrigerant supplied from one of the refrigerant ejection ports 212.

The refrigerant discharge ports 218 are formed in the connecting groove 240 at an interval in the longitudinal direction LD. The refrigerant flows through the refrigerant guide grooves 230 into the connecting groove 240 and is discharged from the discharge ports 218. Each of the refrigerant discharge ports 218 is formed at a part of the connecting groove 240 apart from the connecting points between the connecting groove 240 and the refrigerant guide grooves 230. That is, each of the refrigerant discharge ports 218 is formed in an intermediate position between the connecting points between the connecting groove 240 and adjacent ones of the refrigerant guide grooves.

Each of the flanges P3 of the press-molded product P includes parts P31 requiring relatively high surface accuracy (hereinafter referred to as "parts 31 requiring the surface accuracy"). In this embodiment, the parts P31 requiring the surface accuracy are parts to be welded, which are arranged at an interval in the longitudinal direction LD of the press-molded product P. The refrigerant guide grooves 230 extend not toward the parts of the flanges molding parts 201C for molding the parts P31 requiring the surface accuracy but toward the parts for molding the parts requiring lower surface accuracy, while avoiding the parts P31 requiring the surface accuracy.

Refrigerant Flow Path in Press-Molding Surface 102 of Upper Mold 104

Figure 3:
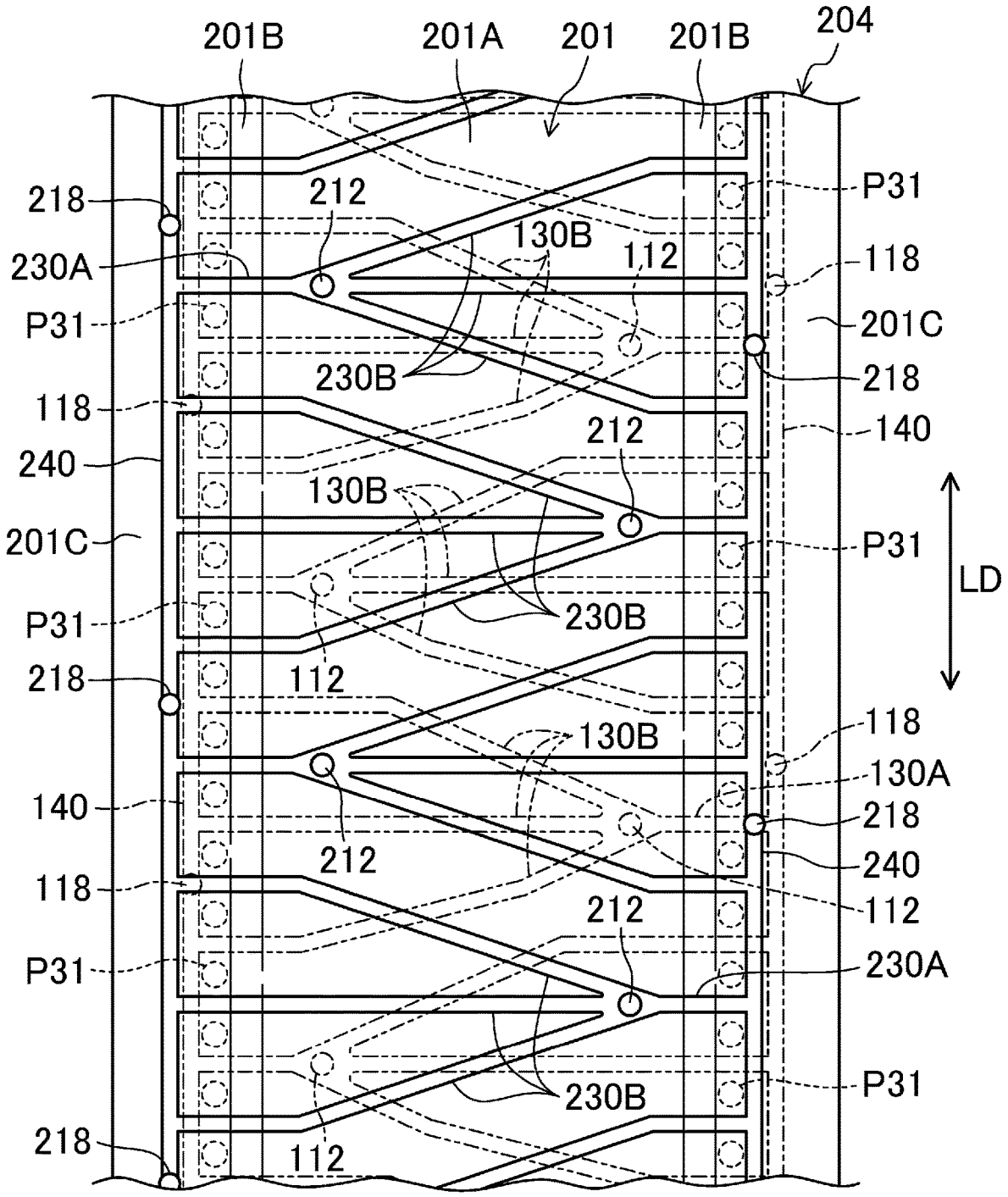
FIG. 3 is a plan view of refrigerant flow paths of upper and lower molds of the machine.

FIG. 3, a plan view, illustrates the overlapping refrigerant flow paths of the press-molding surface 201 of the lower mold 204 and the press-molding surface 101 of the upper mold 104. The former is indicated by solid lines, whereas the latter is indicated by two-dot chain lines.

Although not shown in the drawing, in order to form the press-molded product P with the hat-like cross section together with the press-molding surface 201 of the lower mold 204, the press molding surface 101 of the upper mold 104 includes a top wall molding part, side wall molding parts, and flange molding parts (i.e., the outer portion of the press molding surface 101) corresponding to the top wall molding part 201A, the side wall molding parts 201B, and the flange molding parts 201C of the press-molding surface 201 of the lower mold 204, respectively. Like the press-molding surface 201 of the lower mold 204, a plurality of the refrigerant ejection ports 112 are formed in the top wall molding part of the press-molding surface 101 of the upper mold 104, and a plurality of the refrigerant discharge ports 118 are formed in the flange molding parts. Connecting grooves 140 and the refrigerant guide grooves 130 connecting these refrigerant ejection ports 112 to the refrigerant discharge ports 118 are formed in the press-molding surface 101.

Hereinafter, reference numeral 130 is used to collectively refer to the refrigerant guide grooves of the upper mold 104, and alphabetic characters are added to the reference numeral 130 like "130A" to refer to the individual refrigerant guide grooves.

As is apparent from FIG. 3, the refrigerant flow path of the upper mold 104 has an inverted pattern of the refrigerant flow path of the lower mold 204. The configurations of the refrigerant flow path are basically the same as those of the lower mold 204. Although repetitive explanation may thus be included, the refrigerant flow path of the upper mold 104 will now be described in detail.

Like the lower mold 204, the refrigerant ejection ports 112 are arranged alternately on one and the other sides of the top wall molding part of the press-molding surface 101 of the upper mold 104, when the press-molding surface 101 is viewed in its longitudinal direction LD. However, each of the refrigerant ejection ports 112 on one side of the upper mold 104 is located in an intermediate position between adjacent ones of the refrigerant ejection ports 212 on one side of the lower mold 204. Each of the refrigerant ejection ports 112 on the other side of the upper mold 104 is located in an intermediate position between adjacent ones of the refrigerant ejection ports 212 on the other side of the lower mold 204.

Like the refrigerant guide grooves 230 of the lower mold 204, the refrigerant guide grooves 130 of the upper mold 104 extend from the refrigerant ejection ports 112 not in the longitudinal direction but in the transverse direction of the press-molding surface 101. In this embodiment, a plurality of independent refrigerant guide grooves 130A and 130B extend from the refrigerant ejection ports 112.

Specifically, the single refrigerant guide groove 130A and a plurality of refrigerant guide grooves 130B extend from each of the refrigerant ejection ports 112 on one side of the top wall molding part 101A. The refrigerant guide groove 130A extends from the top wall molding part across the side wall molding part on the one side to the flange molding part on the one side. The refrigerant guide grooves 130B extend through the top wall molding part to the side wall molding part on the other side at an interval expanding in the longitudinal direction LD of the press-molding surface 101. The refrigerant guide grooves 130B extend across this side wall molding part to the flange molding part on the other side.

Similarly, a single refrigerant guide groove 130A and a plurality of refrigerant guide grooves 130B extend from each of the refrigerant ejection ports 112 on the other side of the top wall molding part. The refrigerant guide groove 130A extends from the top wall molding part across the side wall molding part on the other side to the flange molding part on the other side. The refrigerant guide grooves 130B extend through the top wall molding part to the side wall molding part on the one side at an interval expanding in the longitudinal direction LD of the press-molding surface 101. The refrigerant guide grooves 130B extend across this side wall molding part to the flange molding part on the one side.

The refrigerant guide grooves 130 extend not toward the parts of the flanges molding parts for molding the parts P31 requiring the surface accuracy but toward the parts for molding the parts requiring lower surface accuracy.

The refrigerant guide grooves 130B extending from each of the refrigerant ejection ports 112 on one side toward the other side include, between adjacent ones of the refrigerant ejection ports 112 on the other side, a part in which the interval expands toward the other side. This is for aligning the refrigerant ejection ports 112 on the other side and the refrigerant guide grooves 130B at a substantially equal interval in the longitudinal direction LD of the press-molding surface 101.

Similarly, the refrigerant guide grooves 130B extending from each of the refrigerant ejection ports 112 on the other side toward the one side include, between adjacent ones of the refrigerant ejection ports 112 on the one side, a part in which the interval expands toward the one side. This is for aligning the refrigerant ejection ports 112 on the one side and the refrigerant guide grooves 130B at a substantially equal interval in the longitudinal direction LD of the press-molding surface 101.

Such alternate arrangement of the refrigerant ejection ports 112 and such arrangement of the refrigerant guide grooves 130B extending from the refrigerant ejection ports 112 at the expanding interval allow the refrigerant guide grooves 130 to cover the whole top wall molding part and the whole side wall molding parts of the press-molding surface 201.

Each of the flange molding parts on one and the other sides, which form the outer portion of the press-molding surface 201, has a single connecting groove 140 extending in the longitudinal direction LD of the press-molding surface 101. This connecting groove 140 is connected to the refrigerant guide grooves 130 extending to the one or the other side at an interval in the longitudinal direction LD. The refrigerant guide grooves 130 extending from the refrigerant ejection ports 112 neither branch halfway nor merge with the other refrigerant guide grooves to extend toward the flanges molding parts to be connected to the connecting grooves 140. No refrigerant ejection port is formed halfway in the refrigerant guide grooves 130. Each of the refrigerant guide grooves 130 receives the refrigerant supplied from one of the refrigerant ejection ports 112.

Each of the refrigerant discharge ports 118 is formed at a part of the connecting groove 140 apart from the connecting points between the connecting groove 140 and the refrigerant guide grooves 130, that is, in an intermediate position between the connecting points between the connecting groove 140 and adjacent one of the refrigerant guide grooves. The refrigerant flows through the refrigerant guide grooves 130 into the connecting groove 140 and is discharged from the discharge ports 118.

Advantages of Embodiment

The heated workpiece W is press-molded by the downward movement of the upper mold unit 100 to have the hat-like cross section. While the workpiece W is pressed in this manner, the refrigerant is supplied from the refrigerant ejection ports 112, 212 to the press-molding surface 101, 201 of the upper/lower mold 104, 204. Three or more independent refrigerant guide grooves 130, 230 extend from each of the refrigerant ejection ports 112, 212. Accordingly, the refrigerant guide grooves 130, 230 cool a wide range of the workpiece W per refrigerant ejection port 112, 212.

As described above, the refrigerant guide grooves 130, 230 neither branch halfway nor merge with the other refrigerant guide grooves to extend from the refrigerant ejection ports 112, 212 to the flange molding parts in the transverse direction of the press-molding surface 101, 201. Each of the refrigerant ejection ports supplies the refrigerant to one of the refrigerant guide grooves 130, 230. Each of the refrigerant ejection ports 112, 212 is formed in the top wall molding part, that is, a relatively high position, of the press-molding surface. Each of the refrigerant discharge ports is formed in the one of the flange molding parts, that is, a relatively low position.

Accordingly, the refrigerant ejected from the refrigerant ejection ports 112, 212 smoothly flows in the transverse direction of the press-molding surface 101, 201 without changing the flow rate in the refrigerant guide grooves 130, 230 or causing stagnation due to merging or collision. The refrigerant thus spreads to the outer portion of the press-molding surface 101, 201. This reduces large differences in the temperature of the refrigerant or cooling time of the workpiece between the areas around the refrigerant ejection ports 112, 212 and the areas around the flange molding parts. Accordingly, the press-molded product P is cooled relatively uniformly in the transverse direction of the press-molding surface, which provides relatively uniform quenching strength.

As described above, the refrigerant ejection ports 112, 212 are arranged at the interval in the longitudinal direction of the press-molding surface 101, 201. The refrigerant guide grooves 130, 230 extending from the refrigerant ejection ports 112, 212 cover the entire press molding surface 101, 201. This reduces a large difference in the performance of the refrigerant ejected from the refrigerant ejection ports 112, 212 to cool the workpiece W in the longitudinal direction of the press molding surface 101, 201.

Accordingly, the hot press machine provides a press-molded product with largely uniform strength in the longitudinal and transverse directions of the press-molding surface.

Note that the temperature of the refrigerant increases with an increasing distance from the refrigerant ejection ports 112, 212, since the refrigerant exchanges heat with the workpiece W. That is, the workpiece W is most cooled around the refrigerant ejection ports 112, 212, and the cooling performance deteriorates with an increasing distance from the refrigerant ejection ports 112, 212. By contrast, in this embodiment, the refrigerant ejection ports 112, 212 are arranged alternately on one and the other sides of the press-molding surface 101, 102. This reduces intensive cooling (an intensive increase in the quenching strength) at one part of the workpiece W in the lateral direction and improves the uniformity in the strength of the workpiece W in the lateral direction (i.e., the transverse direction of the press-molding surface 101, 102).

The alternate arrangements of the refrigerant ejection ports 112 of the upper mold 104 and the refrigerant ejection ports 212 of the lower mold 204 are inverted (in inverted manners). The parts of one of the upper and lower molds 104 and 204 in which the refrigerant exhibits higher cooling performance correspond to the parts in which the refrigerant exhibits lower cooling performance of the other of the molds. This further improves the uniformity in the strength of the workpiece W in the lateral direction.

The refrigerant guide grooves 130, 230 extend toward the parts of the flanges molding parts for molding the parts requiring lower surface accuracy, while avoiding the parts P31 of the press-molded product P requiring the surface accuracy. This reduces generation of a quench distortion at the parts P31 requiring the surface accuracy. Therefore, in the case of the embodiment described above, reduction in the weldability of the press-molded product P with the other components at the flanges decreases, which is advantageous in providing the product with high strength.

The refrigerant guided by the refrigerant guide grooves 130, 230 to the flange molding parts flows into the connecting grooves 140, 240 to reach the refrigerant discharge ports 118, 218. The refrigerant discharge ports 118, 218 are formed at parts of the connecting groove 140, 240 apart from the connecting points between the connecting grooves 140, 240 and the refrigerant guide grooves 130, 230. This allows the refrigerant in the refrigerant guide grooves 130, 230 to always flow through the connecting grooves 140, 240 into the refrigerant discharge ports 118, 218, while avoiding direct flow into the refrigerant discharge ports 118, 218 without passing through the connecting grooves 140, 240. In this manner, the refrigerant flows through the connecting grooves 140, 240 of the flange molding parts, which is advantageous in cooling (quenching) the flanges of the press-molded product P.

The fact that the refrigerant flows once from the refrigerant guide grooves 130, 230 into the connecting grooves 140, 240 means that the connecting grooves 140, 240 serve as resistances to the refrigerant flow path. Between some of the connecting points between the connecting grooves 140, 240 and the adjacent refrigerant guide grooves 130, 230, no refrigerant discharge port is formed. Between these connecting points, the refrigerant particularly tends to stagnate to increase the resistance to the flow path, since the refrigerants flowing from the adjacent connecting points to a position therebetween interfere with each other. The significance of this flow path resistance will be described below.

Figure 4:
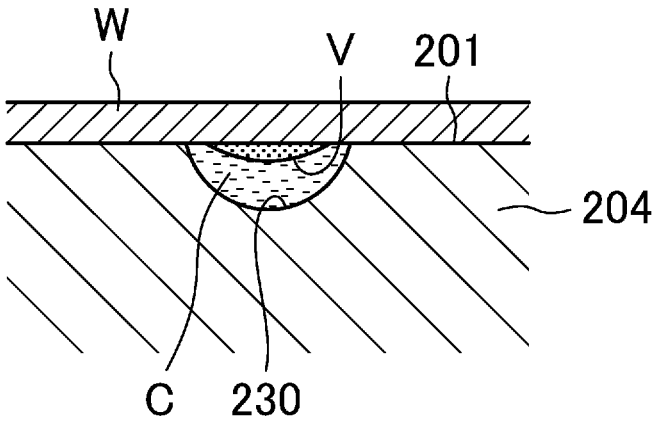
FIG. 4 is a cross-sectional view illustrating a vapor film generated by contact between a refrigerant and a workpiece.

First, in regions in which the workpiece W is in tight contact with the press-molding surface 101, 201, the refrigerant flows while filling the refrigerant guide grooves 130, 230. In regions even with tiny gaps, the refrigerant is less likely to fill the grooves. On the other hand, as shown in FIG. 4, once the refrigerant comes into contact with the workpiece W, a part of the refrigerant is heated by the workpiece W to become steam to generate a vapor film V between the workpiece W and a liquid part C of the refrigerant. The generation of such vapor film V causes insufficient contact between the workpiece W and the liquid part C of the refrigerant, thereby reducing the efficiency of the refrigerant cooling the workpiece W.

In the regions of the refrigerant guide grooves 130, 230 that are likely to be filled by the refrigerant, an increase in the refrigerant ejection pressure increases the filling degree of the refrigerant, when the refrigerant flowing into the connecting grooves 140, 240 described above increases the resistance to the refrigerant flow path. As a result, the vapor film V on the surface of the workpiece W is easily crushed or swept away by the liquid part C of the refrigerant to provide sufficient contact between the liquid part C of the refrigerant and the work W. This reduces a decrease in the cooling efficiency caused by the vapor film V.

Even in the regions of the refrigerant guide grooves 130, 230 that are less likely to be filled by the refrigerant, the refrigerant also easily fills the regions, when the refrigerant flowing into the grooves 140, 240 described above increases the resistance to the refrigerant flow path. The filling refrigerant increases the resistance to the flow path so that the liquid part C easily sweeps away the vapor film V, even if the vapor film V is generated. This reduces a decrease in the cooling efficiency.

In the embodiment described above, the number of the refrigerant guide groove 130A, 230A extending from each refrigerant ejection port 212 is one, but may be more.

In the embodiment described above, the number of the refrigerant guide grooves 130B, 230B extending from each refrigerant ejection port 212 is three, but may be two, four, or more. The number of refrigerant guide grooves 130B, 230B may be larger than the number of refrigerant guide groove(s) 130A and 230A in one preferred embodiment.

Other Embodiments of Refrigerant Flow Path

Other Embodiment 1

Figure 5:
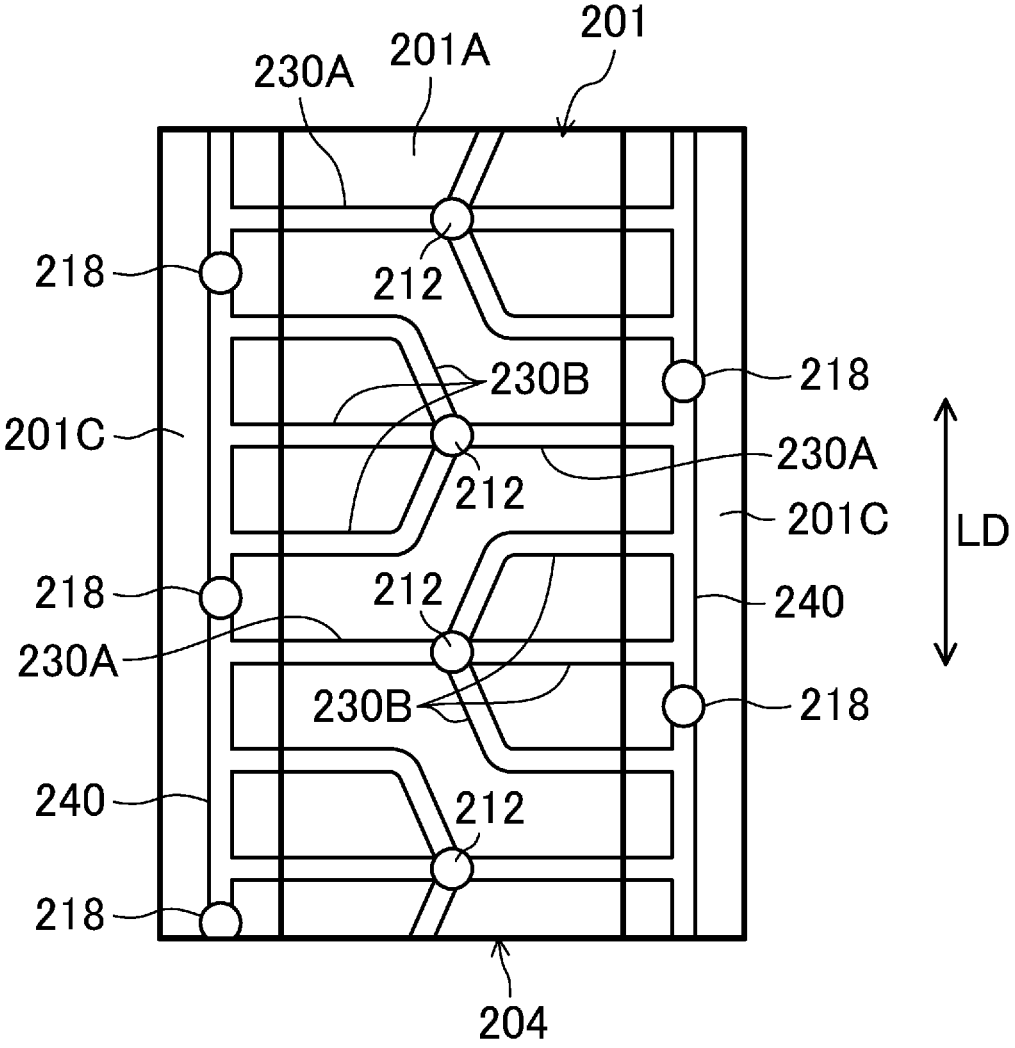
FIG. 5 is a plan view illustrating a refrigerant flow path according to Other Embodiment 1.

An embodiment shown in FIG. 5 will be described. The refrigerant ejection ports 212 are formed in the top wall molding part 201A of the press-molding surface 201 of the lower mold 204. The refrigerant guide grooves 230 extend from the refrigerant ejection ports 212 in the transverse direction of the press-molding surface 201. In these respects, this embodiment is the same as the embodiment described above. The difference is as follows. In this embodiment, the refrigerant ejection ports 212 are formed near the lateral center of the top wall molding part 201A at an interval in the longitudinal direction LD of the press-molding surface 201.

When an adjacent pair of the refrigerant ejection ports 212 is focused on, a single refrigerant guide groove 230A and a plurality of refrigerant guide grooves 230B extend from one of the refrigerant ejection ports 212. The refrigerant guide groove 230A extends toward one side of the press-molding surface 201. The refrigerant guide grooves 230B extend toward the other side of the press-molding surface 201 at an interval expanding in the longitudinal direction LD of the press-molding surface 201. A single refrigerant guide groove 230A and a plurality of refrigerant guide grooves 230B extend from the other of the refrigerant ejection ports 212. The refrigerant guide groove 230A extends toward the other side of the press-molding surface 201. The refrigerant guide grooves 230B extend toward the one side of the press-molding surface 201 at an interval expanding in the longitudinal direction LD of the press-molding surface 201. In these respects and with respect to the configurations of the connecting grooves 240 and the refrigerant discharge ports 218, this embodiment is substantially the same as the embodiment described above.

In this embodiment, the refrigerant ejection ports 212 are aligned along a substantially straight line in the longitudinal direction LD of the press-molding surface 201. There is thus no need to obtain a wide space for arranging the refrigerant ejection ports 212. Therefore, this embodiment is suitable, for example, for a case where the top wall molding part 201A is narrow and obtainment of the space for zigzag arrangement of the refrigerant ejection ports is difficult.

Like the lower mold 204, with respect to the refrigerant flow path of the upper mold, the refrigerant ejection ports are aligned along a substantially straight line at the lateral center of the top wall molding part at an interval in the longitudinal direction of the press-molding surface. In this case, the refrigerant ejection ports of the upper and lower molds may be shifted in the longitudinal direction LD of the press-molding surface 201 in one preferred embodiment not to overlap each other in the vertical direction.

Other Embodiment 2

Figure 6:
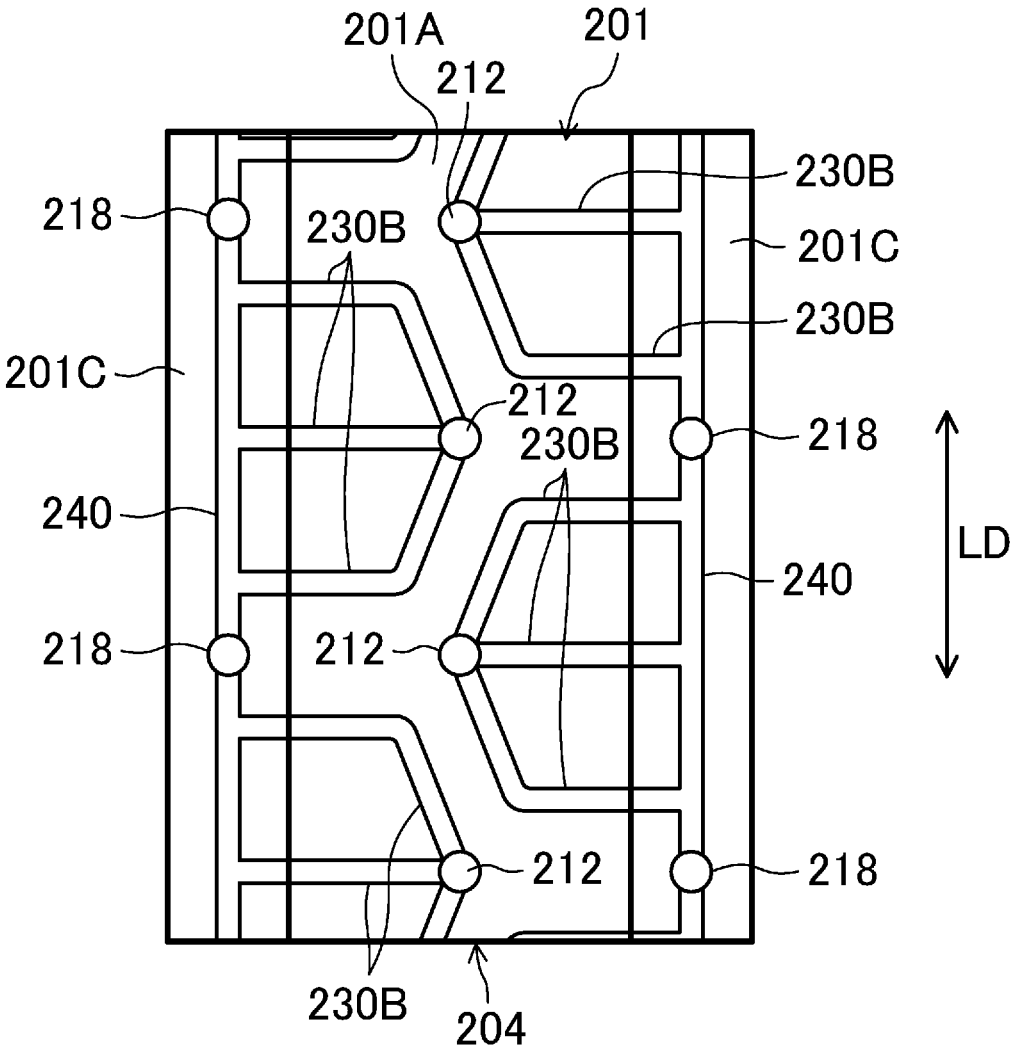
FIG. 6 is a plan view illustrating a refrigerant flow path according to Other Embodiment 2.

An embodiment shown in FIG. 6 is the same as the Other Embodiment 1 in the following respects. The refrigerant ejection ports 212 are formed near the lateral center of the top wall molding part 201A at an interval in the longitudinal direction LD of the press-molding surface 201. The refrigerant guide grooves 230 extend from the refrigerant ejection ports 212 in the transverse direction of the press-molding surface 201. The refrigerant guide grooves include the refrigerant guide grooves 230B extending from the refrigerant ejection ports 212 toward one side of the press-molding surface 201 like in the Other Embodiment 1. There is, however, no members corresponding to the refrigerant guide grooves 230A extending in the opposite direction unlike in the Other Embodiment 1.

The refrigerant guide grooves 230B extend toward the one side of the press-molding surface 201 at an interval expanding in the longitudinal direction LD of the press-molding surface 201. In this respect and with respect to the configurations of the connecting grooves 240 and the refrigerant discharge ports 218, this embodiment is substantially the same as the embodiment described above.

In this embodiment as well, the refrigerant guide grooves 230 can be arranged to cover the entire press-molding surface 201.

The refrigerant flow path of the upper mold may have the same configuration as that of the lower mold 204. In this case, the refrigerant ejection ports of the upper and lower molds may be shifted in the longitudinal direction LD of the press-molding surface 201 in one preferred embodiment not to overlap each other in the vertical direction.

Other Embodiment 3

Figure 7:
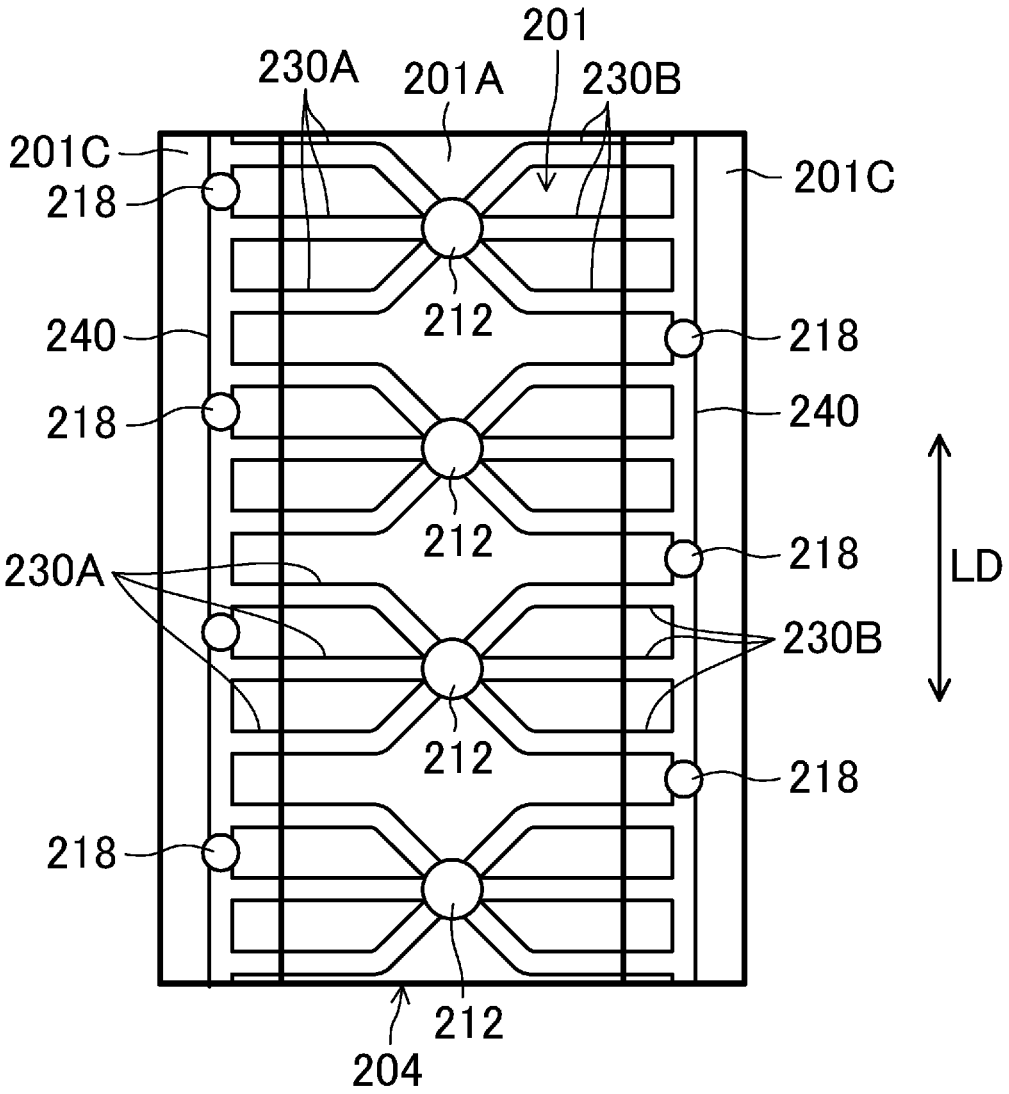
FIG. 7 is a plan view illustrating a refrigerant flow path according to Other Embodiment 3.

An embodiment shown in FIG. 7 is the same as the Other Embodiment 1 in the following respects. The refrigerant ejection ports 212 are formed at the lateral center of the top wall molding part 201A at an interval in the longitudinal direction LD of the press-molding surface 201. The refrigerant guide grooves 230 extend from the refrigerant ejection ports 212 in the transverse direction of the press-molding surface 201. Unlike in the Other Embodiment 1, however, a plurality of refrigerant guide grooves 230A extend from the refrigerant ejection ports 212 toward one side of the press-molding surface 201 and a plurality of refrigerant guide grooves 230B extend to the other side. The refrigerant guide grooves 230A and 230B extend toward the respective sides of the press-molding surface 201 at an interval expanding in the longitudinal direction LD of the press-molding surface 201. With respect to the configurations of the connecting grooves 240 and the refrigerant discharge ports 218, this embodiment is substantially the same as the embodiment described above.

In this embodiment as well, the refrigerant guide grooves 230 can be arranged to cover the entire press-molding surface 201.

The refrigerant flow path of the upper mold may have the same configuration as that of the lower mold 204. In this case, the refrigerant ejection ports of the upper and lower molds may be shifted in the longitudinal direction LD of the press-molding surface 201 in one preferred embodiment not to overlap each other in the vertical direction.

Other Embodiment 4

Figure 8:
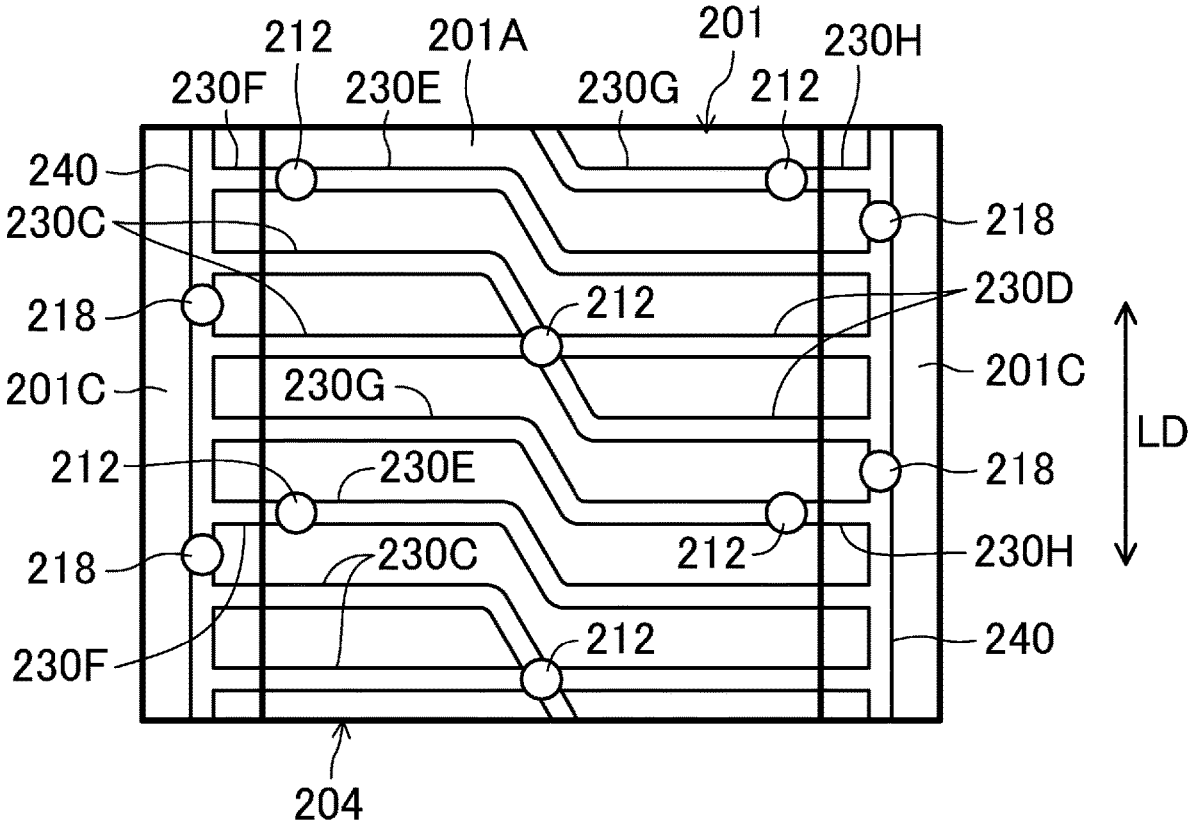
FIG. 8 is a plan view illustrating a refrigerant flow path according to Other Embodiment 4.

In an embodiment shown in FIG. 8, the refrigerant ejection ports 212 are formed at the lateral center and ends of the top wall molding part 201A at an interval in the longitudinal direction LD of the press-molding surface 201. The refrigerant guide grooves 230 extend from the refrigerant ejection ports 212 in the transverse direction of the press-molding surface 201.

Specifically, a plurality of refrigerant guide grooves 230C and a plurality of refrigerant guide grooves 230D extend from each of the refrigerant ejection ports 112 formed at the lateral center of the top wall molding part 201A. The refrigerant guide grooves 230C extends toward one side of the press-molding surface 201. The refrigerant guide grooves 230D extend toward the other side of the press-molding surface 201. A single refrigerant guide groove 230E and a single refrigerant guide groove 230F extend from each of the refrigerant ejection ports 212 formed on one side of the top wall molding part 201A. The refrigerant guide groove 230E extends toward the other side of the press-molding surface 201. The refrigerant guide groove 230F extends toward the one side of the press-molding surface 201. A single refrigerant guide groove 230G and a single refrigerant guide groove 230H extend from each of the refrigerant ejection ports 212 formed on the other side of the top wall molding part 201A. The refrigerant guide groove 230G extends toward the one side of the press-molding surface 201. The refrigerant guide groove 230H extends toward the other side of the press-molding surface 201. Otherwise, with respect to the configurations of the connecting grooves 240 and the refrigerant discharge ports 218, this embodiment is substantially the same as the embodiment described above.

Therefore, this embodiment is suitable for a case where there is a wide space for arranging the refrigerant ejection ports 212 in the top wall molding part 201A. This configuration allows arrangement of the refrigerant guide grooves 230 to cover the entire press-molding surface 201.

The refrigerant flow path of the upper mold may have the same configuration as that of the lower mold 204. In this case, the refrigerant ejection ports of the upper and lower molds may be shifted in the longitudinal direction LD of the press-molding surface 201 in one preferred embodiment not to overlap each other in the vertical direction.

What is claimed is:

1. A hot press machine for press-molding a heated metal workpiece and cooling the pressed workpiece using a refrigerant, the machine comprising:

an upper mold and a lower mold, each having a press-molding surface for press-molding the workpiece into a predetermined shape, the press-molding surfaces corresponding to each other, wherein at least one of the upper mold or the lower mold includes:

a refrigerant ejection port in the press-molding surface to eject the refrigerant;

a plurality of refrigerant guide grooves in the press-molding surface to guide the refrigerant ejected from the refrigerant ejection port to an outer portion of the press-molding surface with the refrigerant being in contact with the workpiece;

a single connecting groove connected to the refrigerant guide grooves and formed at the outer portion of the press-molding surface into which the refrigerant flows from the refrigerant guide grooves; and a refrigerant discharge port in the connecting groove, the refrigerant discharge port is formed at a part of the connecting groove apart from connecting points between the connecting groove and the refrigerant guide grooves, the refrigerant ejection port includes a plurality of refrigerant ejection ports arranged at an interval in the press-molding surface, the press-molding surface extends in a longitudinal direction corresponding to a length direction of the workpiece, at least a part of the press-molding surface has the refrigerant ejection ports arranged alternately on one side and the other side of the press-molding surface, when the press-molding surface is viewed in the longitudinal direction, some of the refrigerant guide grooves extend from each of the refrigerant ejection ports formed on the one side of the press-molding surface toward the other side of the press-molding surface, the others of the refrigerant guide grooves extend from each of the refrigerant ejection ports formed on the other side of the press-molding surface toward the one side of the press-molding surface, each of the upper and the lower molds includes: the refrigerant ejection ports arranged alternately; and the refrigerant guide grooves extending from the refrigerant ejection ports, and each of the refrigerant ejection ports on the one side of one of the upper and the lower molds is located in an intermediate position between adjacent ones of the refrigerant ejection ports on the one side of the other of the molds, and each of the refrigerant ejection ports on the other side of one of the upper and the lower molds is located in an intermediate position between adjacent ones of the refrigerant ejection ports on the other side of the other of the molds.

2. The machine of claim 1, wherein the refrigerant guide grooves extend from the refrigerant ejection port not in the longitudinal direction but in a transverse direction of the press-molding surface.

3. The machine of claim 1, wherein in order to provide a press-molded product with a substantially concave cross section from the workpiece, the press molding surface of each of the upper and the lower molds includes:

a top wall molding part configured to mold a top wall of the concave press-molded product;

side wall molding parts continuous with the top wall molding part and configured to mold side walls of the press-molded product, the side wall molding parts corresponding to each other; and flange molding parts continuous with the respective side wall molding parts and configured to mold flanges of the press-molded product, the refrigerant ejection port is formed in the top wall molding part of the press-molding surface, the refrigerant guide grooves extend from the refrigerant ejection ports in the top wall molding part through the side wall molding parts to the flange molding parts that form the outer portion of the press-molding surface, and the refrigerant discharge port is formed in the flange molding part.

4. The machine of claim 1, wherein the refrigerant is a liquid.

5. A hot press machine for press-molding a heated metal workpiece and cooling the pressed workpiece using a refrigerant, the machine comprising:

an upper mold and a lower mold, each having a press-molding surface for press-molding the workpiece into a predetermined shape, the press-molding surfaces corresponding to each other, wherein at least one of the upper mold or the lower mold includes:

a refrigerant ejection port in the press-molding surface to eject the refrigerant;

a plurality of refrigerant guide grooves in the press-molding surface to guide the refrigerant ejected from the refrigerant ejection port to an outer portion of the press-molding surface with the refrigerant being in contact with the workpiece;

a single connecting groove connected to the refrigerant guide grooves and formed at the outer portion of the press-molding surface into which the refrigerant flows from the refrigerant guide grooves; and a refrigerant discharge port in the connecting groove, the refrigerant discharge port is formed at a part of the connecting groove apart from connecting points between the connecting groove and the refrigerant guide grooves, the refrigerant ejection port includes a plurality of refrigerant ejection ports arranged at an interval in the press-molding surface, the press-molding surface extends in a longitudinal direction corresponding to a length direction of the workpiece, at least a part of the press-molding surface has the refrigerant ejection ports arranged alternately on one side and the other side of the press-molding surface, when the press-molding surface is viewed in the longitudinal direction, some of the refrigerant guide grooves extend from each of the refrigerant ejection ports formed on the one side of the press-molding surface toward the other side of the press-molding surface, the others of the refrigerant guide grooves extend from each of the refrigerant ejection ports formed on the other side of the press-molding surface toward the one side of the press-molding surface, in order to provide a press-molded product with a substantially concave cross section from the workpiece, the press molding surface of each of the upper and the lower molds includes:

a top wall molding part configured to mold a top wall of the concave press-molded product;

side wall molding parts continuous with the top wall molding part and configured to mold side walls of the press-molded product, the side wall molding parts corresponding to each other; and flange molding parts continuous with the respective side wall molding parts and configured to mold flanges of the press-molded product, the refrigerant ejection port is formed in the top wall molding part of the press-molding surface, the refrigerant guide grooves extend from the refrigerant ejection ports in the top wall molding part through the side wall molding parts to the flange molding parts that form the outer portion of the press-molding surface, and the refrigerant discharge port is formed in the flange molding part, and the press molding surface of each of the upper and the lower molds is configured to provide a press-molded product in which:

each of the flanges of the press-molded product includes a first part and a second part, the first part requiring a higher surface accuracy than the second part, and each of the refrigerant guide grooves extends not toward the first part of an associated one of the flange molding parts but toward the second part.

6. The machine of claim 5, wherein the refrigerant guide grooves extend from the refrigerant ejection port not in the longitudinal direction but in a transverse direction of the press-molding surface.

7. The machine of claim 5, wherein the refrigerant is a liquid.

* * * * *